United States Patent [19]

Reddell

[11] Patent Number: 4,901,378

[45] Date of Patent: Feb. 20, 1990

[54] SHAMPOO BASIN

[76] Inventor: Lealyce Reddell, P.O. Box 986, Mena, Ark. 71953

[21] Appl. No.: 298,356

[22] Filed: Jan. 19, 1989

[51] Int. Cl.[4] ..... A45D 19/00; A45D 19/08

[52] U.S. Cl. ..... 4/515; 4/516; 4/518; 4/519; 4/523

[58] Field of Search ..... 4/515–519, 4/522, 523; 128/65, 66; D23/271, 308; D28/20; D6/596, 601

[56] References Cited

U.S. PATENT DOCUMENTS

| | | | |
|---|---|---|---|
| 2,818,585 | 1/1958 | Campbell | 4/523 X |
| 2,854,969 | 10/1958 | Nolan | 4/518 X |
| 2,854,970 | 10/1958 | Nolan | 4/517 X |
| 3,292,186 | 12/1966 | Turmenna et al. | 4/519 |
| 3,894,546 | 7/1975 | Nolan | 128/65 X |
| 4,512,043 | 4/1985 | Nolan | 4/516 |
| 4,651,361 | 3/1987 | Nolan | 4/516 |

*Primary Examiner*—Henry K. Artis
*Attorney, Agent, or Firm*—Boyd D. Cox

[57] ABSTRACT

A first embodiment of an improved shampoo basin includes an integral spray rinse assembly positioned proximate a neck supporting portion of the basin. The spray rinse assembly facilitates the rinsing of a user's neck and hair in normally difficult to reach areas. Water temperature and pressure control are also provided, and the spray rinse may be selectively operated by a foot pedal arrangement. A modified embodiment of the basin is of a portable design which permits it to be attached to a conventional shampoo basin.

19 Claims, 3 Drawing Sheets

SHAMPOO BASIN

BACKGROUND OF THE INVENTION

1. Field of the Invention

The present invention relates to shampoo basins, and more particularly pertains to a new and improved wash basin which is particularly designed for use during the washing and shampooing of an individual's hair.

2. Description of the Prior Art

The use of specially designed shampoo basins which facilitate the efficient washing and shampooing of a person's hair are well known in the prior art. While these types of basins include many different designs, one of the more popular is a type commonly used in beauty and hair cutting salons. More specifically, a typical beauty parlor wash and shampoo basin includes a substantially semi-circular notch in a forward wall portion thereof, with this notch serving as a support for the user's head. The user's neck can be positioned within the notch, and the hair covered portion of the user's head is substantially retained within and positioned over the basin. The hair may then be washed and shampooed in a convenient manner, and a manually movable spray hose assembly is normally utilized to remove the soap from the hair.

While being functional for their intended purposes, these prior art conventional shampoo basins possess one major disadvantage. In this respect, it can be appreciated that it is difficult to direct a spray of water to the hair located around a back portion of the user's neck due to the proximity of the user's head to the side of the basin. Quite typically, soap is not completely removed from this area of the user's head and when all the soap is efficiently removed, it is frequently done so at the expense of the user comfort, i.e., the user must normally endure some discomfort from having his head raised and a spray nozzle positioned between his head and the side of the sink basin during rinsing. Frequently, the awkward positioning of the user's head results in water running down his neck and the concurrent dampening of his clothes.

In recognition of this problem, there has been developed at least one device designed to rinse the hair proximate a neck supporting notch in a more efficient manner. More specifically, reference is made to U.S. Pat. No. 4,512,043, which issued to W. Nolan on Apr. 23, 1985. A portable hair shampoo and scalp treatment basin is disclosed in this patent with such basin including a water supplied rinse line having a double nozzle arrangement on an end thereof. The spray rinse line is of a flexible design and includes a first nozzle for directing a water spray over the top portion of a head of hair. A second nozzle is attached to a rigid L-shaped conduit which extends downwardly from and is attached to the first nozzle. The second nozzle is positionable beneath a person's head supported within the notch and operates to direct a spray of water to the hair around the user's neck. Although this arrangement does serve to more efficiently rinse the hair over the entire area of a person's head, it is apparent that the above described problem of discomfort is not totally eliminated inasmuch as it is still necessary to position a spray rinse nozzle beneath the user's head and the side of the sink basin. While providing the possibility of user discomfort, it is also obvious that the second nozzle will be substantially concealed during use which could result in an inefficient rinsing due to improper nozzle positioning.

As such, it can be appreciated that there exists a continuing need for some type of improved shampoo basin of the above described type wherein a more efficient means for rinsing the hair on the lower back portion of the user's head and neck can be achieved, and in this respect, the present invention substantially addresses this need.

SUMMARY OF THE INVENTION

In view of the foregoing disadvantages inherent in the known types of conventional shampoo basins now present in the prior art, the present invention provides an improved shampoo basin wherein integral rinse means are provided for rinsing a lower back or dorsal portion of a user's head and neck, thereby eliminating the need for a manually directed rinse of the hair located in this region. As such, the general purpose of the present invention, which will be described subsequently in greater detail, is to provide a new and improved shampoo basin which has all the advantages of the prior art conventional shampoo basins and none of the disadvantages.

To attain this, a first embodiment of the present invention includes a spray assembly integrally molded into a lower portion of a neck supporting notch forming a part of a conventional shampoo basin. Water pressure and temperature control are provided, and a foot control mechanism allows a selective directing of water to the spray assembly when the user's head is in position. Accordingly, soap may be removed from the user's head in this lower back region as well as from the user's neck without the necessity of manipulating a manual spray nozzle in an attempt to achieve such a rinsing.

In a second embodiment, a basin insert for a conventional shampoo basin is provided with a spray head adapted to be positioned beneath the head and neck of an individual. The insert includes integrally molded hook shaped support members for engagement with the upper edge of the conventional shampoo basin. A notch is formed in the basin insert between the support hooks and is dimensioned for registry with the neck support notch of the conventional shampoo basin. The basin insert allows a conventional shampoo basin to be inexpensively converted to facillitate convenient rinsing of the dorsal portions of the head and neck of an individual.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shampoo basin which has all the advantages of the prior art shampoo basins and none of the disadvantages.

It is another object of the present invention to provide a new and improved shampoo basin which may be easily and efficiently manufactured and marketed.

It is a further object of the present invention to provide a new and improved shampoo basin which is of a durable and reliable construction.

An even further object of the present invention is to provide a new and improved shampoo basin which is susceptible of a low cost of manufacture with regard to both materials and labor, and which accordingly is then susceptible of low prices of sale to the consuming public, thereby making such shampoo basins economically available to the buying public.

Still yet another object of the present invention is to provide a new and improved shampoo basin which provides in the apparatuses and methods of the prior art some of the advantages thereof, while simultaneously overcoming some of the disadvantages normally associated therewith.

Still another object of the present invention is to provide a new and improved shampoo basin which facilitates a more efficient rinsing of a user's hair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
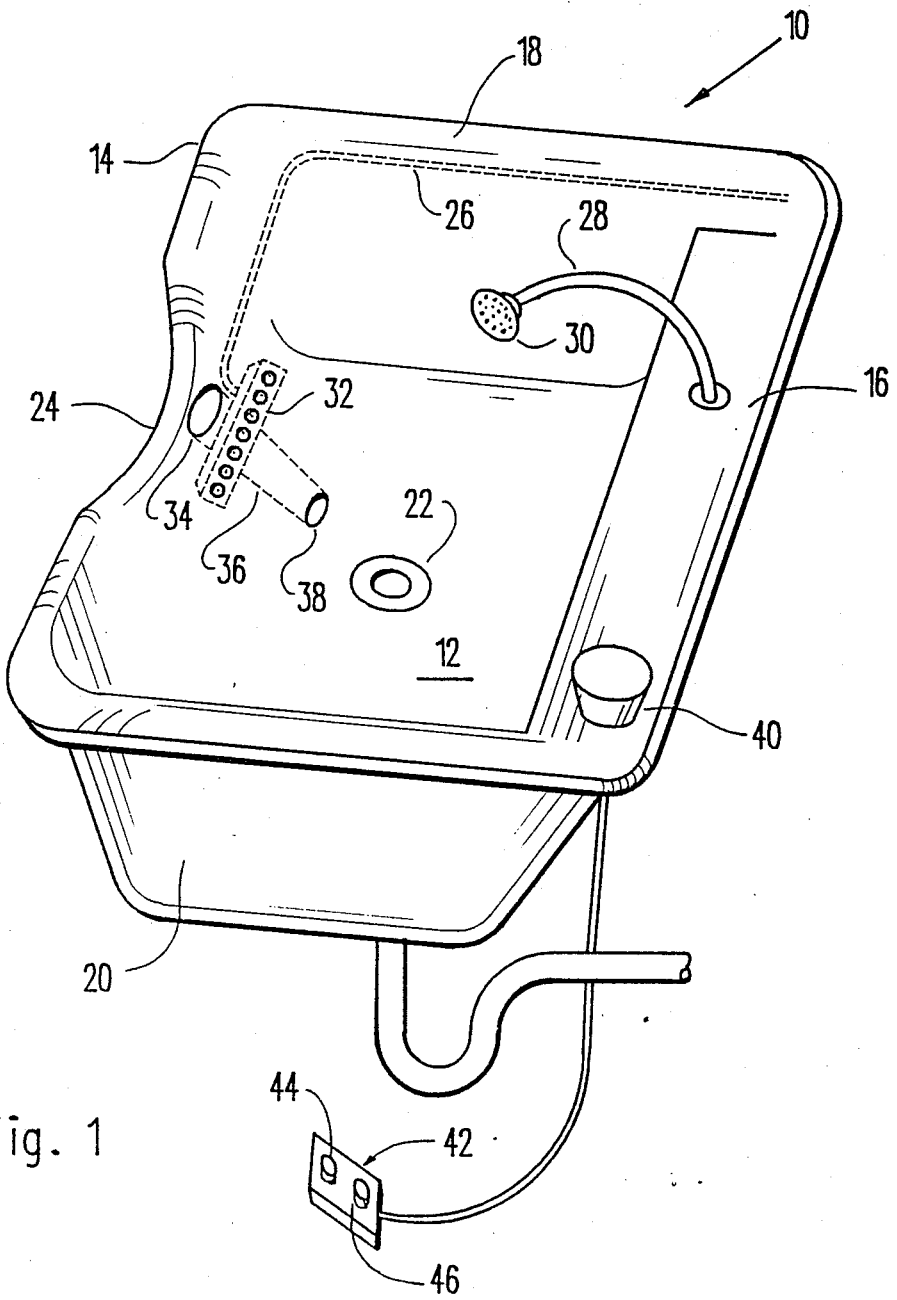
FIG. 1 is a perspective view of the improved shampoo basin according to a first embodiment of the present invention.

With reference now to the single drawing, a first embodiment of a new and improved shampoo basin embodying the principles and concepts of the present invention and generally designated by the reference numeral 10 will be described.

More specifically, it will be noted that the basin 10 is of a substantially rectangular shape and includes a floor 12, an integrally attached front wall 14, a rear wall 16, and opposed sidewalls 18, 20. An opening 22 is provided in the floor 12 of the basin 10, and this opening serves as a drain for liquid runoff which accumulates during a conventional shampoo and rinse.

With particular reference to the front wall portion 14 of the basin 10, there is illustrated a substantially semicircular notch 24 which serves as a support for the neck of a person having his or her hair rinsed within the basin. In this regard, individuals receiving a shampoo and rinse would normally have their hair completely positioned over the sink 10 and would be facing upwardly from the floor 12 of the basin with their neck being supported within the notch 24.

Further illustrated in the drawing is a fluid delivery conduit 26 which could either be encapsulated within the wall structure of the basin 10 or alternatively, the conduit could be externally mounted on a basin wall, either interiorly or exteriorly of the basin. In the preferred embodiment, the fluid delivery conduit 26 would be in fluid communication with a further flexible fluid delivery conduit 28 having a spray nozzle 30 attached to a free end thereof. In this connection, the fluid delivery line 28 and its associated spray nozzle 30 is of a conventional design normally utilizable with a conventional shampoo basin and allows a shampooer to selectively direct a spray of water over the hair of the person receiving a shampoo.

With further reference to the drawing, it will be noted that the aforementioned water delivery conduit 26 has its discharge end directed to a plurality of small apertures 32 which are molded in or otherwise affixed to the interior wall 14 of the basin 10, thereby to facilitate the delivery of a spray of water to the rear neck and head area of the person receiving the shampoo. The apertures 32 in effect define a second spray nozzle arrangement which permits the delivery of sprayed water to an area of the person's head which is normally difficult to access with the hand held spray nozzle 30. In the preferred embodiment, a spray assembly of apertures 32 will be integrally molded into the basin 10 in the illustrated position proximate the neck supporting notch 24. This embodiment of the invention further includes an overflow aperture 34 positioned above the spray apertures 32. The overflow aperture 34 would desirably be molded within the front wall 14 and would include a drain line 36 which includes a discharge opening 38 for facilitating a draining of overflow liquid back into the basin 10. While the overflow opening 34 has been illustrated as being of relatively small extent, it is to be understood that it could be positioned directly within the notch 24 and could extend substantially there around so as to collect water drainage from the head and neck of the person receiving the rinse, thus to aid in keeping the person dry and to increase the efficiency of the invention.

Other noteworthy features of the first embodiment 10 of the invention include a water pressure and temperature control valve arrangement 40 which is of a conventional design and which is typically utilized with conventional showers and bathtubs. Additionally, the fluid delivery conduit 26 and fluid delivery line 28 could be connected such that they could be selectively utilized or utilized simultaneously. This selective or simultaneous utilization could be controlled by a conventional manually operable valve arrangement or a valve arrangement in association with a foot operated water delivery switch arrangement 42 as illustrated. More particularly, a pair of foot control switches 44 and 46 could be selectively or simultaneously engaged to effect the desired selective or simultaneous delivery of water to either the fluid delivery conduit 26 or fluid delivery line 28 or to both. As is readily apparent, the foot operated water delivery switch arrangement 42 allows for the hands of the person giving the shampoo and rinse to be free from controlling water flows so that the shampoo and rinse can more easily be completed. It is to be understood that the switch and valve assembly described is illustrative of numerous types and designs of switch operated valves which could be utilized in combination with the present invention, and it is within the intent and purview of the present invention to encompass all such conceivable and known designs.

Figure 2:
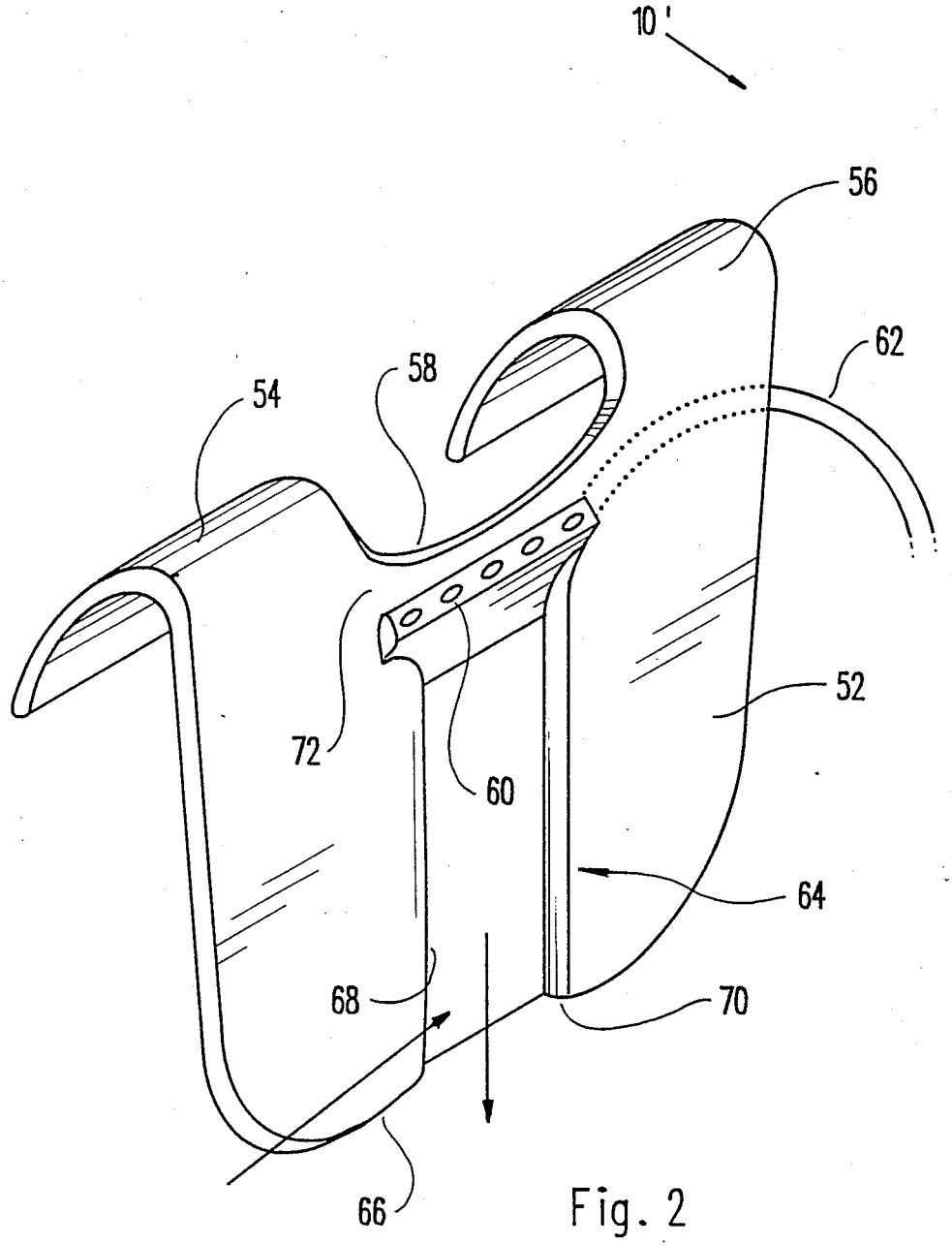
FIG. 2 is a perspective view illustrating a portable basin insert, according to a second embodiment of the invention.

FIG. 2 of the drawings illustrates a second embodiment of the invention which is of a portable design and which is generally designated by the reference numeral 10'. More particularly, it will be noted that the embodiment 10' essentially comprises a basin-shaped structure 52 having curvilinearly-shaped support hook members 54, 56 integrally or otherwise fixedly secured thereto. The support members 54, 56 are designed to be attached to a conventional shampoo basin so as to position the basin 52 within the conventional shampoo basin. The support members 54, 56 are substantially parallel and define a neck receiving notch 58 which is similar in design to the notch 24 (FIG. 1) forming a part of their first embodiment 10 of the invention.

With continuing reference to FIG. 2, there is shown a plurality of water spray directing apertures 60 which are fixedly secured to or otherwise molded into the basin 52 proximate the neck receiving notch 58. A flexible water supply conduit 62 may be connected to the water spray directing apertures 60 in a manner similar to the connection shown in FIG. 1, whereby a spray of water may be selectively directed to the back of the head and neck of a user.

FIG. 2 further illustrates a drain trough 64 formed in the basin 52. With the end 66 of the basin 52 supported in an unillustrated sink or the like, water dispensed from the apertures 60 will drain from the user's head and be directed by the trough 64 into the sink as indicated by the illustrated arrows.

The trough 64 may be designed in various ways to facilitate water retention and drainage. In the preferred embodiment, the trough 64 may include concave, inwardly directed channels 68, 70 along edges thereof. The channels 68, 70 are particularly efficient in capturing water spray and directing the same into the trough 64. Additionally, a curvilinearly-shaped upstanding lip or shelf 72 may be provided between the notch 58 and the apertures 60. The lip 72 serves to deflect water spray into the trough 64 in a now apparent manner.

The second embodiment 10' of the present invention would desirably be of a lightweight and durable construction, and could include virtually all of the features shown in the first embodiment 10. The integral design of the portable basin 10' could be achieved by a molding process utilizing a thermosetting resin or some similar polymer material.

Figure 3:
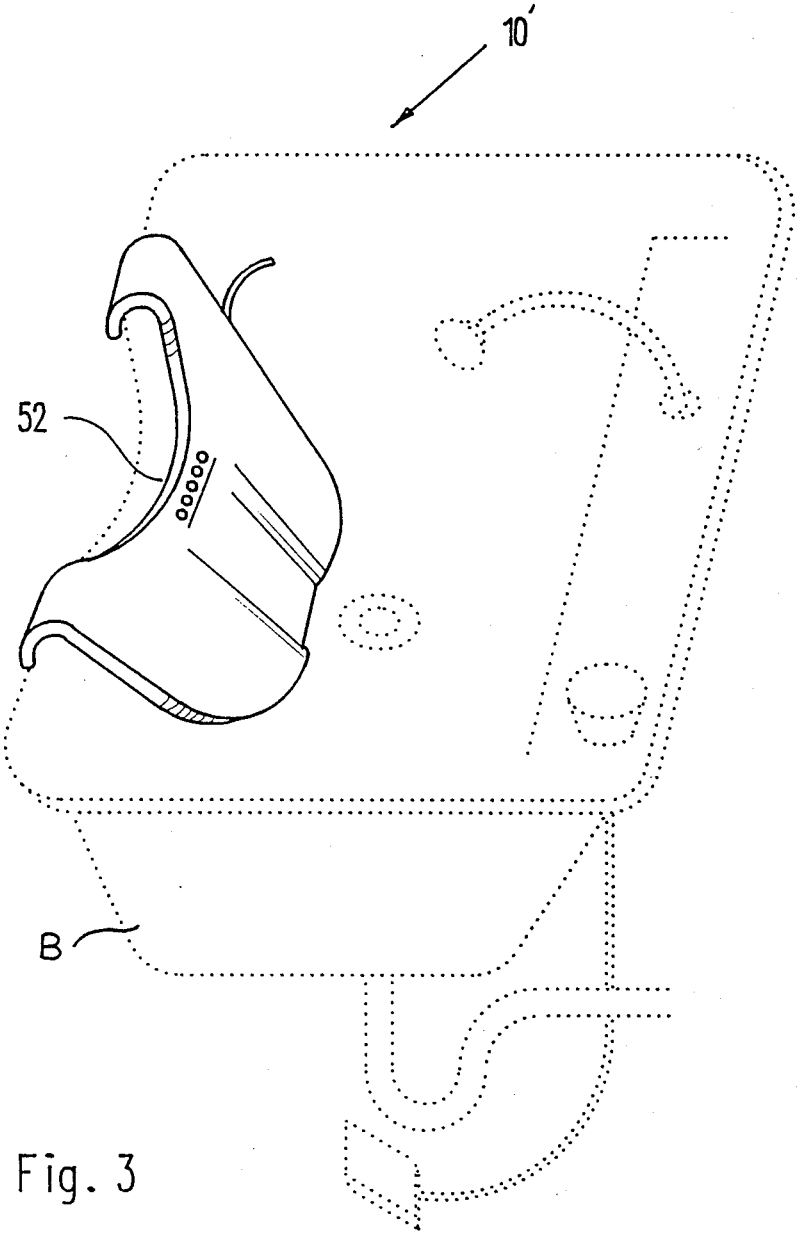
FIG. 3 is a perspective view illustrating the basin insert of the second embodiment disposed in an operative position within a conventional shampoo basin.

FIG. 3 illustrates the portable basin insert 10' disposed in operative orientation within a conventional shampoo basin B. The portable basin insert 10' allows ordinary shampoo basins to be inexpensively converted to provide spray rinse and wash water to the back of the neck and head of an individual.

As to the manner of usage and operation of the present invention, the same should be apparent from the above description. Accordingly, no further description regarding the manner of usage and operation will now be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A shampoo basin, comprising:

basin means;

said basin means including a floor portion having a drain means positioned therein;

a substantially semi-circular notch formed in said basin means;

said notch providing a support means for said head of said person during usage of said basin;

and first rinse means fixedly attached to said basin means proximate said notch, said first rinse means serving to supply water to a dorsal surface of a person's head and neck.

2. The shampoo basin of claim 1, wherein said first rinse means includes at least one aperture for directing at least one stream of water from below a person's head and neck onto a dorsal surface thereof.

3. The shampoo basin of claim 2, wherein said first rinse means further includes an overflow means.

4. The shampoo basin of claim 3, and further including a water pressure and temperature control means for said water delivered to said first rinse means.

5. The shampoo basin of claim 1, and further including second rinse means comprising a flexibly movable spray assembly in fluid communication with a water supply means, said water supply means also being in fluid communication with said first rinse means.

6. The shampoo basin of claim 5, further comprising means for independently directing water to said first and second rinse means.

7. The shampoo basin of claim 6, wherein said means for independently directing water further comprises electric switch means to operatively connected to actuate valves to control flow of water to said first and second rinse means.

8. A shampoo basin designed to more efficiently rinse with water the hair of a person receiving a shampoo, said basin comprising:

basin means, said basin means including a floor portion having a drain means positioned therein;

a substantially semi-circular notch formed in said basin means, said notch providing a support means for said head of said person during usage of said basin;

first rinse means fixedly attached to said basin means proximate said notch, said first rinse means serving to supply water to a dorsal surface of a person's head and neck; and overflow means positioned proximate said first rinse means, said overflow means serving to facilitate drainage of water from a person's head and neck into said basin means.

9. The shampoo basin of claim 8, wherein said overflow means comprises at least one opening in said basin means for receiving and channeling said water away from a person's head and neck and into said basin means.

10. The shampoo basin of claim 8, wherein said first rinse means comprises a plurality of water spray directing apertures formed in said basin means.

11. The shampoo basin of claim 5, wherein said second rinse means is fixedly securable to said basin means.

12. The shampoo basin of claim 1, wherein said first rinse means comprises a plurality of water directing spray apertures formed in said basin means and being positioned proximate said notch, thereby to efficiently direct a spray of water to a dorsal surface of a person's head and neck.

13. The shampoo basin of claim 12, and further including overflow means positioned proximate said first rinse means, said overflow means serving to facilitate drainage of water from a person's head and neck into said basin means.

14. The shampoo basin of claim 13, wherein said overflow means comprises at least one opening in said basin means for receiving and channeling water away from a person's head and neck and into said basin means.

15. A portable shampoo basin insert for use in a conventional shampoo basin of the type having a neck receiving notch, said insert comprising:

a basin body portion;

support means on said basin body portion for supporting said basin body portion within said conventional shampoo basin;

a notch in said basin body portion dimensioned for registry with said conventional shampoo basin notch;

spray means on said basin body portion proximate said notch for directing a flow of water to a dorsal surface of a person's head and neck received in said notch;

and conduit means for connecting said spray means to a water supply.

16. The shampoo basin insert of claim 15 wherein said support means comprises a pair of arcuate hook-shaped support members disposed on opposite sides of said basin insert notch.

17. The shampoo basin insert of claim 15, further comprising an elongated trough in said basin insert for draining water from said spray means.

18. The shampoo basin insert of claim 17, further comprising an upstanding spray shield lip on said basin body portion disposed between said spray means and said notch.

19. The shampoo basing insert of claim 15, wherein said basin body portion is integrally molded from a plastic material.

* * * * *